United States Patent [19]

Tsai

[11] 4,406,555

[45] Sep. 27, 1983

[54] NIB REPLACEABLE WRITING INSTRUMENT

[75] Inventor: Kuo L. Tsai, Taipei, Taiwan

[73] Assignee: Cathay Pen Corporation, Taipei, Taiwan; a part interest

[21] Appl. No.: 260,923

[22] Filed: May 6, 1981

[51] Int. Cl.[3] ..... B43K 7/10; B43K 27/00

[52] U.S. Cl. ..... 401/216; 401/17; 401/21; 401/199; 401/209

[58] Field of Search ..... 401/17-21, 401/109-114, 29-33, 132, 133, 135, 187, 188, 190, 191, 196, 198, 199, 202, 207, 209, 213, 214, 216, 217, 195

[56] References Cited

U.S. PATENT DOCUMENTS

| | | | |
|---|---|---|---|
| 559,034 | 4/1896 | Laughlin | 401/141 |
| 2,476,321 | 7/1949 | Perwas | 401/151 |
| 2,846,977 | 8/1958 | Aston | 401/216 |
| 2,872,899 | 2/1959 | Trespalacios | 401/227 |
| 3,941,488 | 3/1976 | Maxwell | 401/17 |

FOREIGN PATENT DOCUMENTS

| | | | |
|---|---|---|---|
| 816360 | 10/1951 | Fed. Rep. of Germany | 401/32 |
| 2816366 | 10/1979 | Fed. Rep. of Germany | 401/29 |
| 935742 | 2/1948 | France | 401/216 |
| 978585 | 11/1950 | France | 401/17 |
| 12390 | of 1888 | United Kingdom | 401/20 |
| 8800 | of 1904 | United Kingdom | 401/209 |

*Primary Examiner*—Clyde I. Coughenour

*Attorney, Agent, or Firm*—LeBlanc, Nolan, Shur & Nies

[57] ABSTRACT

A writing instrument with a nib that is easily removed and replaced with a spare unit stored inside the pen holder. A capillary and ink core guide is provided to supply ink from storage to a ball or other writing means.

3 Claims, 10 Drawing Figures

NIB REPLACEABLE WRITING INSTRUMENT

BACKGROUND OF THE INVENTION

The present invention relates to a nib replaceable writing instrument and more particularly, to a writing instrument having manually separable parts of nib and pen holder so that either new nibs or different gauges of pen point can be arbitrarily changed.

Conventional writing instruments, cellulose-nib or ball-nib pen for signatory, which is having a fastened or all-in-one part of nib and pen holder in favor of production and assembly line; therefore, it is impossible to separate nib from pen holder without proper tool or otherwise by destruction. Once the nib is broken or worn out, one can only discard the whole pen even if the pen holder is still in good shape. During the era of serious energy shortage like recent years, it is out prime responsibility to have limited energy and natureal resources fully and effectively utilized.

As the gauge or the finess of a conventional writing instrument is fixed, therefore, one has to provide several pieces of writing instruments for different purposes, such as for engineering drawing or for signatory.

SUMMARY OF THE DISCLOSURE

Therefore, the principal objective of the present invention is to provide a kind of writing instrument with replaceable pen-nib, so that, to enable the full use of pen holder or the other parts which is only necessary to replace the damaged parts.

Another objective of the present invention is to provide a spare pen-nib equipped-in the pen holder of this writing instrument which is immediately replaceable as soon as the existing pen-nib is worn out or damaged, which assure you no interruption of writing during important occassions, i.e. dictating a letter, attending an important press conference or an examination.

Still another objective of the present invention is to provide a kind of writing instrument with a series of spare pen-nibs of different gauges equipped-in the pen holder for different requirement in different occassions, so that it will gives one a sense of satisfaction by using a writing instrument for all purposes.

Other objects and further applicability of the present invention will become more apparent when taken in conjuntion with the accompanying drawings.

DESCRIPTION OF THE PREFERRED EMBODIMENTS

For the sake of easy cross references between the description of each preferred embodiments of the present invention, we assign same reference number and affixed (when required) with alphabetical capital letter.

The replaceable pen-nib of the writing instrument in this invention, the main structural improvement includes, firstly, an optionally removable part between the front part of pen holder and pen-nib, and secondary, an optionally replaceable part in the rear part of the pen holder where could store spare pen nibs of different gauges.

Figure 1:
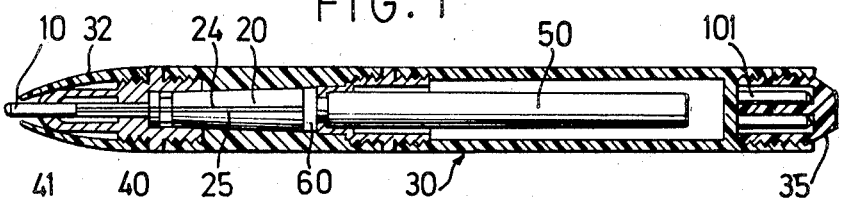
FIG. 1 is a partly cross sectional view of an embodiment of the present invention.

The writing instrument of the present invention, as shown in FIG. 1, comprises a ball pen nib 10 to use an aqueous ink solution, a capillary type ink guiding element 20, pen nib cover 32, pen holder 30, ink storage cartridge 50, adapter 40, and packing 60. As shown in the drawing, pen nib 10 is held by an adapter 40 and tightened by means of screwed-in pen-nib cover 32 to the pen holder 30.

Figure 4A:
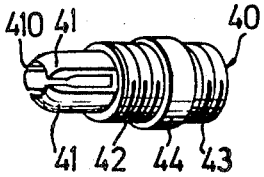
FIG. 4A is a perspective view of an embodiment of pen-nib cover of this invention.

The construction of adapter 40 is shown in FIG. 4A. Gripper 41—41 is an integral part of adapter 40 to be formed in one time. The front screw 42 of the flange 44 is to be screwed together with pen-nib cover 32 and the rear screw 43 is to be fit by screwing with the front part of pen holder 30. The space 410 between grippers 41 and 41, is enabling air passage as well as ink flow.

When unscrewing the pen nib cover 32, it is very easy to remove pen nib 10, by reverse operation, the pen nib 10 shall be tightened to the pen holder 30. When the pen nib 10 in use is worn out, a spare pen nib 101 in the rear part of pen holder could be taken out by unscrewing rear and cover 35 to replace the damaged one.

Figure 2A:
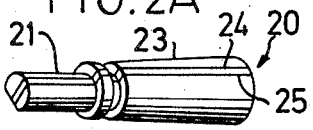
FIG. 2A is a perspective view of the first embodiment of the capillary ink guide of this invention.
Figure 2B:
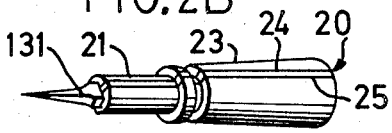
FIG. 2B is a perspective view of the second embodiment of the capillary ink guide of this invention.
Figure 3A:
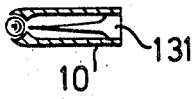
FIG. 3A is a cross sectional view of pen-nib of this invention.
Figure 3B:
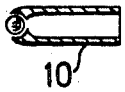
FIG. 3B is a cross sectional view of another embodiment of pen-nib of this invention.

In this invention, the capillary type ink guiding element 20 may be designed like FIG. 2A or 2B. In FIG. 2A, it shows that at least more than one capillary type grooves 24, 25 are cut in the outer surface of element 20 from the middle larger diameter portion 23 to the front smaller diameter portion 21 thereof, and the pen nib 10 contacting the front end of the element 20 will be made in the form like FIG. 3A, while in FIG. 2B shows that the capillary tube guiding core 131 in the pen nib 10 is to be an integral part of said ink guiding element 20, thus making the replaceable pen nib to be constructed like FIG. 3B. In this manner, the type of the pen nibs stored in the rear part of the pen holder shall be changed accordingly.

Figure 5:
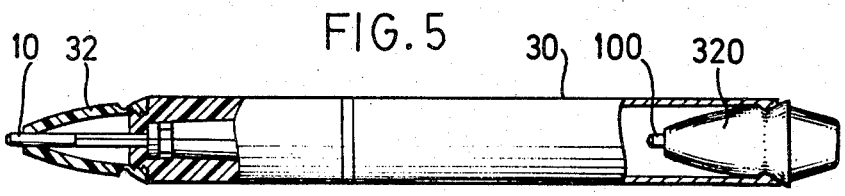
FIG. 5 is a partly sectional view of another embodiment of the present invention.

The capillary element 20 and ink guiding core 131 are mounted in a relationship of face-to-face abutment as shown in FIG. 5. On the closely abutting face of the capillary member 20 is formed one or more radial or crossed capillary grooves which are extensions of the longitudinal capillary grooves 24, 25 on the outer surface of said capillary member 20, so as to effectively enhance its capillary ink-guiding function and enable the fitting of many different gauges of writing nib, for example, a ball point pen nib 10 to induce the ink from said ink reservoir 50 flowing to the pen nibs 10 mentioned above or to replace thereof for writing. Since the capillary grooves at the front end face of said capillary member 20 effectively enhance the capillary function of conveying ink from the ink reservoir 50, each of such different gauges of pen nibs, after being fitted on the pen holder 30, can be used for smooth and fluent writing.

Figure 4B:
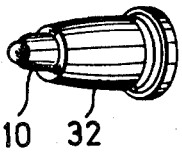
FIG. 4B is perspective view of another embodiment of pen-nib cover of this invention.

Another embodiment of the replaceable pen nib of the present invention is shown in FIGS. 4B and 5. The pen nib and the pen-nib cover 32 are combined together as one unit and to fix on the front part of the pen holder 30 by either slip on or screw-on methods.

It is to be understood that the pen-nib cover 32, as shown in FIG. 5, is screwed on the pen holder 30 while the spare pen nib 100 with its cover 320 is fixable by either slip on or screw-on to the rear part of the pen holder 30.

It will be appreciated that according to the present invention, the replaceable nib writing instrument is also applicable to the signature pen for using semi-oily ink. As shown in FIG. 6, a conventional signature pen consists of an ink storing cellulosic element 50A in the pen holder 30A, thus enabling to convey the ink to pen nib 10A by means of ink guiding core 20. The writing instrument of this kind commonly available in the market, is usually designed to have an integral unit of pen-nib cover and pen holder being casted or formed together and fitted tightly to the front end of the pen holder by force. This kind of construction is based upon the convenience of manufacturing as well as assembling processes instead of facilitating the replacement of parts, consequently, which is not advisable to replace pen nib by hand. While the present invention, the replaceable nib writing instrument, the pen-nib cover is designed to have its construction like 32A of FIG. 6A, the pen-nib cover 32A is designed to have its length be easily held by fingers which could be screwed on the front part of pen holder 30A. The construction of the pen holder 30A, is as usual, having an air equalizing hole 33. In this embodiment, pen nib 10A is fitted to the inside of pen-nib cover 32A, and the front half of ink guiding core 20A is in turn closely held to the inside of pen nib 10A.

When replacing pen nib 10A, all you have to do is to unscrew the pen-nib cover 32A, the pen nib 10A together with the front half core 20A will be separable from the pen holder 30A. Also, when screwing pen-nib cover 32A on the pen holder 30A, the front half core 20A will engage with the main guiding core 20 so as to have a smooth ink flowing effect by capillary tube phenomenon.

Figure 6B:
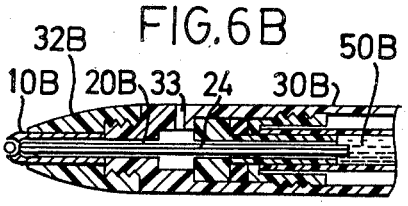
FIG. 6B is a partly sectional view of still another
Figure 6A:
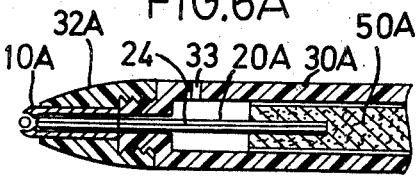
FIG. 6A is partly sectional view of still another embodiment of the present invention.

In the meantime, the main ink guiding core 20 in the above mentioned illustrations can be made in a whole piece as shown in FIG. 6B, which will directly reach the pen nib 10B. When unscrewing pen-nib cover 32B from pen holder 30B for replacement, only the pen nib 10B will be separated, leaving its guiding core 20B remains in the pen holder at extended length. This kind of construction is more favorable for the slip on type construction of ink storage cartridge 50B.

It is to be emphasized that according to the present invention, the ink guiding cores 20A and 20B mentioned above also have to cut on its outer surface at least one longitudinal capillary type grooves 24, 25 to make further smooth the guidance and feed of ink.

It will be appreciated that the above description of the embodiments are illustrative only and numerous modification are variations may be made in light of the above teachings, such as, in the same manner cellulose pen nib may also be applicable to the construction of pen-nib cover of this invention instead of ball point pen-nib mentioned above. It is therefore to be understood that within the scope of the appended claims, the invention may be practiced otherwise than as specifically described herein.

I claim:

1. A replaceable nib writing instrument comprising a pen casing having a central opening at its otherwise closed front end, a pen-nib holding means connected at the front of said casing, a pen nib having writing point in the form of a ball point at its utmost front end, said pen nib using an ink solution and being firmly held inside of said holding means by a portion thereof, an ink storage means positioned at the rear of said casing, an ink guiding means connected between said pen nib and ink storage means to convey the ink from said ink storage means to the pen nib, said ink guiding means including a capillary member and an ink guiding core, said capillary member having a relatively smaller diameter portion at the front and a relatively larger diameter portion at the rear, said relatively larger diameter portion of said capillary member being frictionally held within the inner surface of the front of said casing, and the rear of the relatively smaller diameter portion of said capillary member being further tightly mounted at the central opening of the closed front end of said casing, the remainder of said relatively smaller diameter portion being extended through said central opening at the front end of said casing and projected out of the same, and having at least one longitudinal capillary groove extending the entire length of the outer surface of said capillary member for transferring ink from said longitudinal capillary groove of said capillary member to said pen nib, said capillary member and said ink guiding core being mounted in face-to-face abutment, the abutting face of said capillary member being provided with at least one capillary groove which communicates with said longitudinal capillary groove, and which is surrounded and enclosed within the housing of said pen-nib holding means and makes no substantial contact with the inner surface of said pen-nib holding means, whereby said pen-nib holdng means and its nib may be interchanged with a similar pen-nib holding means having a nib of the same type, said ink guiding core including a front end having a greatly reduced slim portion and a minor portion of the rear end mounted at the end of said pen nib so that a sufficient amount of ink is stored within said pen nib to effect a continuous capillary action for the writing point, the reduced slim point of said ink guiding core making no contact with said writing point.

2. An instrument as defined in claim 1 additionally comprising means for storing a spare pen nib holding means with its pen nib using an ink solution at the rear of said casing.

3. An instrument as defined in claim 1, wherein the length of the pen nib is shorter than that of said pen-nib holding means so as to enable the projecting front end of said capillary member to engage with said pen nib in a form of face-to-face abutment inside said pen-nib holding means.

* * * * *